US005088140A

United States Patent [19]

Belcher et al.

[11] Patent Number: 5,088,140

[45] Date of Patent: Feb. 18, 1992

[54] PILLOWS OF POLYESTER FIBERFILL

[75] Inventors: Wilbur D. Belcher, Wilmington, Del.; Teddy H. Grindstaff, Kinston, N.C.

[73] Assignee: E. I. du Pont de Nemours and Company, Wilmington, Del.

[21] Appl. No.: 420,452

[22] Filed: Oct. 12, 1989

Related U.S. Application Data

[63] Continuation-in-part of Ser. No. 228,800, Jul. 28, 1988, abandoned, which is a continuation of Ser. No. 934,200, Nov. 21, 1986, abandoned.

[51] Int. Cl.[5] ..... A47C 20/00

[52] U.S. Cl. ..... 5/636; 264/211.14; 264/129

[58] Field of Search ..... 5/431, 434; 264/211.14, 264/129

[56] References Cited

U.S. PATENT DOCUMENTS

| | | | |
|---|---|---|---|
| Re. 27,587 | 2/1973 | Paliyenko et al. | 5/434 |
| 3,110,617 | 11/1963 | Scott | 427/175 |
| 3,892,909 | 7/1975 | Miller | 5/434 |
| 4,316,924 | 2/1982 | Minemura et al. | 428/89 |
| 4,396,389 | 8/1983 | Löfgren | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 850169 | 9/1960 | United Kingdom . |
| 1093628 | 12/1967 | United Kingdom . |
| 1276329 | 6/1972 | United Kingdom . |

OTHER PUBLICATIONS

Herman Ludewig, Polyester Fibers—Chemistry and Technology, 1964, Engl Transl 1971, John Wiley and Sons Ltd., pp. 387–389.

*Primary Examiner*—Hubert C. Lorin

[57] ABSTRACT

An improved pillow of polyester fiberfill whose surface has been modified by treatment of freshly-extruded polyester filaments with caustic, preferably in a spin-finish, so as to improve the moisture-wicking properties.

5 Claims, No Drawings

PILLOWS OF POLYESTER FIBERFILL

CROSS-REFERENCE TO RELATED APPLICATIONS

This application is a continuation-in-part of copending application Ser. No. 07/228 800 filed July 28, 1988, now abandoned which itself is a continuation of application Ser. No. 06/934,200, filed Nov. 21, 1986, now abandoned.

TECHNICAL FIELD

This invention concerns improvements in pillows or like bedding or furnishing articles whose filling material consists essentially entirely or in significant amount of polyester fiberfill, and to the new polyester fiberfill used in such articles, and in processes in and relating thereto

BACKGROUND OF THE INVENTION

Most existing filled articles, such as pillows for example, are filled with insulating material, so that body heat has been retained. This can be an advantage in sleeping bags, and in cold unheated surroundings, but can be a source of discomfort in certain circumstances, for instance in hot weather and/or with feverish patients, particularly if the person may be overweight or otherwise overheated. Because of the insulating advantages of filled bedding and furnishing articles in certain circumstances, such as cold weather and cold surroundings, the disadvantage in heated surroundings has generally hitherto been considered inevitable, but it has long been desirable to improve pillows and other articles, so that they would remain cooler than existing articles.

Accordingly, it is an objective of the invention to provide a "cool pillow", in the sense that the pillow or other furnishing or bedding article would remain cooler than conventional articles during prolonged contact with human bodies.

Polyester fiberfill has long been disclosed and used, alone or in admixture with other materials, as a filling material in pillows and like bedding and furnishing articles, such as cushions, as disclosed by Le Van, U.S. Pat. No 3,510,888, and Tolliver, U.S. Pat. No 3,772,137, by way of example. Polyester fiberfill has many advantages as a filling material, and improvements are constantly being made in this field.

Polyester filaments have been characterized by their extreme hydrophobic character, as mentioned in "Polyester Fibres—Chemistry and Technology", by H. Ludewig—English translation 1971—John Wiley and Sons, Ltd., in Section 11.1.5 on pages 377–378, and also in Section 11.4 on dyeing properties, starting on page 398. Ludewig's book mentions many aspects of polyester fibers and their preparation and properties.

We solve the problem of providing a "cool pillow" by improving the moisture-wicking properties of the polyester filling, and do this in a simple manner that has not been previously suggested.

SUMMARY OF THE INVENTION

According to the present invention, there is provided an improvement in pillow or like bedding or furnishing article whose filling material comprises at least 25% by weight of polyester fiberfill, wherein the polyester fiberfill has been prepared by a process of melt-spinning polyester into filaments, treating the freshly-extruded filaments with a spin-finish and collecting them in the form of a bundle, further processing such filaments in the form of a tow, if desired, by drawing and possibly annealing to increase orientation and crystallinity, crimping to produce crimped filaments, and if desired converting such crimped filaments to staple fiber, the improvement characterized by treating the freshly-extruded polyester filaments with a small amount of caustic, in sufficient amount and sufficiently rapidly so as to modify the surface of the polyester, so as to improve their moisture-wicking properties, after washing.

The improvement in moisture-wicking properties of the polyester filaments provided according to the present invention is believed to improve the "cool" feel of the pillow, and to contribute accordingly to the comfort in hot weather of the body in contact with the pillow over a prolonged period of time. It will be understood that more than 25% by weight of the caustic-treated polyester fiber may be used, e.g. 50% or more, and especially filling material consisting essentially of such polyester fiberfill.

There are also provided, according to the present invention, the improved polyester fiberfill, whose surface has been modified by caustic treatment in accordance with the invention, and the various processes for preparing the fibers and articles referred to herein.

DETAILED DESCRIPTION OF THE INVENTION

At this point, we refer to copending applications Ser. No. 07/420,457 (DP-4265-B) and Ser. No. 07/420,458 DP-4266-B) filed simultaneously herewith, because they describe corresponding treatment of polyester filaments during the preparation, respectively, of filamentary tows, staple fiber and spun yarn therefrom, and of filament yarns (DTFY) and textured yarns therefrom, and because development of those technologies has proceeded further, and so the disclosures therein are incorporated by reference, particularly in regard to the working Examples and processing techniques. It is believed that essentially similar technical findings will apply to the present invention and fiber materials herein, and because several comments and in particular tests and comparisons, and some aspects of thresholds and amounts, related therein, could apply to the polyester filaments treated according to the present invention, with, however, also a caution that, since an essential element of the invention concerns working with freshly-extruded filaments and a rate phenomenon, as disclosed therein, in other words since this is a freshly-exposed surface phenomenon, if the dimensions and quantities of the treated filaments are changed significantly, adjustments have had to be made to the quantities of caustic to achieve the same desired effect, as can be seen by a comparison of the working Examples in the copending cases referred to.

For convenience, despite the fact that the surface has been changed, so that the moisture-wicking characteristics are not what has hitherto been associated with "polyester" filaments, we shall refer to both treated and untreated materials by the term "polyester", for reasons which will be apparent.

The preparation of the polyester fiberfill may be carried out conventionally except for the application of caustic to the freshly-extruded filaments, and then the treated filaments may be processed conventionally, including drawing, and eventually making filled article, as disclosed in the art, e.g by conventional techniques.

Reference may be made, e.g., to LeVan, Tolliver and Ludewig, referred to above, and to Marcus U.S. Pat. Nos 4,618,531, 4,783,364, 4,794,038 and 4,818,599, to copending application Ser. No. 07/334,832, filed Apr. 7, 1989 in the name of Broaddus, and to the references mentioned therein. According to the invention, any such conventional process is modified by treating the freshly-extruded filaments with caustic, such as caustic soda or caustic potash. As indicated, this may most conveniently be effected by adding an appropriate amount of caustic to the finish that is applied to the freshly-extruded filaments, since the application of finish is essentially the first treatment or contact that the freshly-extruded filaments encounter after solidification. It is important, according to the invention, that this treatment with caustic be effected on these freshly-extruded filaments, which are often referred to as "live" filaments, since the effect appears to be different from that obtained if caustic soda is applied at a later stage to fabrics, according to prior art teaching If the application of a small amount of caustic is not sufficiently prompt, the caustic will not improve the moisture-wicking properties significantly, as discussed in the copending application 07/420,457 (DP-4265-B) referred to. This copending application mentions that, for improved wicking, it is desirable to provide the polyester with at least 0.2 CE (surface carboxyl equivalents per million grams of drawn fiber), this level being almost twice the background level (generally 0.12–0.13 CE) of regular polyester, and that the wicking action is better with higher levels, such as at least 0.3 CE, and even more, such as 0.5 CE.

We believe that caustic treatment effects a chemical change at the surface of the filament, from its regular hydrophobic nature, that has been a characteristic of polyester as reported, e.g. by Ludewig The core appears to be relatively unchanged from regular polyester polymer, whereas the surface has been significantly changed so that the fiberfill shows improved moisture-wicking properties, after washing. Since the treatment is applied to the surface of the freshly-extruded filament, which is undrawn, and this filament is then subjected to a drawing process, in which the surface of the filament is significantly increased, which must mean that new surface is created from polymer that had previously been concealed beneath the surface of the undrawn filament, it is extremely surprising that the improvement in properties is shown in drawn material, whereas it was the undrawn filament that was treated with caustic In order to obtain the improved properties, the filament surfaces must be washed, as described in the above-mentioned copending application Ser. No. 07/420,457 (DP-4265-B). This may occur at any stage of processing of the treated filaments.

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as caustic, even in the small amounts indicated, at this stage of the process. This is at least one reason why, so far as we know, hitherto, there has previously been a prejudice against the use of a material such as caustic at this stage of a process for preparing polyester fiberfill In this regard, it should be recognized that the filaments travel at high speeds, so that it is difficult to avoid slinging,, i.e., release of droplets of finish from these high speed filaments after application of the finish.

In copending application Ser. No. 07/420,457 (DP-4265-B) caustic soda (NaOH) has been used, and in copending application Ser. No. 07/420,458 (DP-4266-B) caustic potash has been used to improve the moisture-wicking performance of polyester yarns, and fabrics thereof, so it is to be expected that other alkali metal hydroxides, alkaline earth metal hydroxides or equivalent basic materials may give an essentially equivalent effect.

As mentioned in copending application Ser. No. 07/420,457 (DP-4265-B), fabrics and garments from the spun yarns in the Example therein are expected to provide soft, dry, cool and airy aesthetics, and more breathability, and that the hydrophilic surface-modified polyester is expected to give even more of the advantages where improved moisture-wicking is important, such as coolness and dryness, (as compared with prior art polyester that has not been surface-modified). Similarly, fiberfill and filled articles according to the present invention are expected to show advantages where moisture-wicking is important.

The filaments may be of conventional deniers and other characteristics for making fiberfill using conventional techniques. The filaments may be round and solid or hollow, and of any cross-sections, such as may be desired for polyester fiberfill.

In addition to conventional polyester, i e. poly(ethylene terephthalate) such as is used in the Examples of the copending applications mentioned above, other polyesters, such as copolymers, may be used, and changes may be made accordingly to correspond with such changes to the polymer, e.g. in the methods of preparation and testing. The advantage of the invention is that the normal hydrophobic surface is significantly changed by the simple treatment of freshly-extruded filaments with caustic according to the invention, and the invention is not considered restricted by the nature of the polyester polymer, nor by the cross-section or configuration of the filaments.

We claim:

1. An improved pillow or like bedding or furnishing article whose filling material comprises at least 25% by weight of polyester fiberfill, wherein the polyester fiberfill has been prepared by a process of melt-spinning polyester into filaments that are quenched as they are withdrawn from the spinneret at a speed termed the withdrawal speed treating the freshly-extruded filaments with a spin-finish and collecting them in the form of a bundle, further processing such filaments in the form of a tow by drawing and annealing to increase orientation and crystallinity, crimping to produce crimped filaments, and converting such crimped filaments to staple fiber, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to improve the moisture-wicking properties, after washing as indicated by the polyester having at least 0.2 surface carboxyl equivalents per million grams of drawn fiber.

2. A pillow according to claim 1, whose filling material consists essentially of polyester fiberfill that has been prepared by a process of melt-spinning polyester into filaments that are quenched as they are withdrawn from the spinneret at a speed termed the withdrawal speed, treating the freshly-extruded filaments with a spin-finish and collecting them in the form of a bundle, further processing such filaments in the form of a tow by drawing and annealing to increase orientation and crystallinity, crimping to produce crimped filaments, and converting such crimped filaments to staple fiber, wherein the improvement consists in treating the freshly-extruded polyester filaments with spin-finish containing an amount of caustic selected and at a location selected such that, in combination with the withdrawal speed and quenching conditions, the caustic treatment is sufficiently soon so as to modify the surface of the polyester so as to improve the moisture-wicking properties, after washing, as indicated by the polyester having at least 0.2 surface carboxyl equivalents per million grams of drawn fiber.

3. An improved pillow or like bedding or furnishing article whose filling material comprises at least 25% by weight of polyester fiberfill, wherein the polyester fiberfill has been prepared by a process of melt-spinning polyester into filaments that are quenched as they are withdraw from the spinneret at a speed termed the withdrawal speed, treating the freshly-extruded filaments with a spin-finish and collecting them in the form of a bundle, further processing such filaments in the form of a tow by drawing and annealing to increase orientation and crystallinity, and crimping to produce crimped filaments, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester so as to improve the moisture-wicking properties, after washing, as indicated by the polyester having at least 0.2 surface carboxyl equivalents per million grams of drawn fiber.

4. A pillow according to claim 3, whose filling material consists essentially of polyester fiberfill that has been prepared by a process of melt-spinning polyester into filaments that are quenched as they are withdrawn from the spinneret at a speed termed the withdrawal speed, treating the freshly-extruded filaments with a spin-finish and collecting them in the form of a bundle, further processing such filaments in the form of a tow by drawing and annealing to increase orientation and crystallinity, and crimping to produce crimped filaments, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester so as to improve the moisture-wicking properties, after washing, as indicated by the polyester having at least 0.2 surface carboxyl equivalents per million grams of drawn fiber.

5. A pillow according to any one of claims 1, 2, 3 or 4, wherein the freshly-extruded polyester filaments are treated so that the polyester has at least 0.3 surface carboxyl equivalents per million grams of drawn fiber.

* * * * *